United States Patent [19]

Humphries et al.

[11] Patent Number: 4,624,593

[45] Date of Patent: Nov. 25, 1986

[54] IMPACT PRINTER CLEANING SYSTEM

[76] Inventors: Deborah A. Humphries; Karla J. von Hungen, both of 1684 Market St., San Francisco, Calif. 94102

[21] Appl. No.: 732,130

[22] Filed: May 8, 1985

[51] Int. Cl.[4] ..... B41F 35/00; A47L 25/00

[52] U.S. Cl. ..... 400/702; 15/210 R

[58] Field of Search ..... 400/194, 195, 196, 196.1, 400/202, 202.1, 202.2, 202.3, 202.4, 701, 702, 702.1, 124, 208; 15/210 R; 360/128

[56] References Cited

U.S. PATENT DOCUMENTS

| | | | |
|---|---|---|---|
| 3,872,961 | 3/1975 | St. James | 400/702 |
| 4,252,448 | 2/1981 | Johnson et al. | 400/701 |
| 4,388,663 | 6/1983 | Becella | 360/128 |
| 4,462,056 | 7/1984 | Kara | 360/128 |
| 4,462,553 | 7/1984 | Hashimoto | 360/128 |
| 4,493,572 | 1/1985 | Van Ocker et al. | 400/195 |
| 4,498,113 | 2/1985 | Clausen et al. | 360/128 |
| 4,558,482 | 12/1985 | Neuman et al. | 400/701 |

FOREIGN PATENT DOCUMENTS

| | | | |
|---|---|---|---|
| 2811346 | 3/1978 | Fed. Rep. of Germany | 400/701 |
| 2743966 | 4/1979 | Fed. Rep. of Germany | 400/702 |
| 3146242 | 11/1981 | Fed. Rep. of Germany | 400/701 |
| 53-145640 | 12/1978 | Japan | 702/ |
| 829617 | 3/1960 | United Kingdom | 15/210 R |

OTHER PUBLICATIONS

"U. Matic Recorder Cleaner" Brochure; Dec. 1975; Video Cassette Services.

27 IBM Technical Disclosure Bulletin, No. 10B, pp. 5925–5926, Mar., 1985.

*Primary Examiner*—Edgar S. Burr

*Assistant Examiner*—David A. Wiecking

*Attorney, Agent, or Firm*—Townsend and Townsend

[57] ABSTRACT

A cleaning system for removing ink, dirt, and the like from impact-type printing devices, such as dot matrix printers, daisy wheel printers, and typewriters. The cleaning system includes a cartridge body adapted to replace the inked ribbon cartridge of the device to be cleaned, and a flexible and absorbent ribbon retained within the cartridge body such that when the cleaning cassette is inserted in the printer device, the cleaning ribbon is interposable between the print head and the platen. The cleaning cartridge also includes, in a region of the cassette body adjacent a portion of the cleaning ribbon about to be advanced along the print head, a hole for dispensing a solvent onto the cleaning ribbon. When the printer is operated with the cleaning cassette, the ribbon drive of the printer advances the solvent-wetted portion of the cleaning ribbon between the print head and the printer platen so that the print head strikes the cleaning ribbon. Further advancement of the ribbon dries the print head.

1 Claim, 2 Drawing Figures

IMPACT PRINTER CLEANING SYSTEM

BACKGROUND OF THE INVENTION

This invention relates to an apparatus and method for cleaning ink, fibers, and the like from impact printer print heads; more specifically, this invention relates to an apparatus and method for cleaning dot-matrix print heads and the like.

Print heads of dot matrix printers, letter-quality printers, and other impact printers must be periodically cleaned to remove built-up ink, fibers, and other dirt from the print head. Build-up of ink and fibers on print heads degrades the printing quality and definition available with the printer. With printers that are computer-controllable to print diagrams, letters, etc. in multiple colors, the necessity for frequent cleaning of the print head is greatly increased. When printing is done in multiple colors, the print head should be cleaned after each application of a different color; if the print head is not cleaned, ink of one color adhering to the print head may bleed through the ribbon impregnated with a second color, causing mixing of colors, muddy impressions, and similar problems.

Various methods and kits for cleaning dot matrix print heads, daisy wheels, and other impact-type printers are known. One such system consists of a fibrous wad or cloth and a bottle of solvent. The solvent is applied to the wad; the wetted wad is, in turn, used to daub the ink and dirt from the print head, keys, or daisy wheel. In using such a system, it is often necessary to remove the print head from the printer for cleaning. Since cleaning is, at best, inconvenient, the operator of the printer may be hesitant to clean the print head as frequently as would be desirable. Often, the alternative to removal of the print head for cleaning is to swab the print head directly; it may be necessary to insert tools or implements between the print head and the printer platen, risking damage to the print head. Moreover, bits of fiber from the fabric or fiber wad may become entangled with the print head and left behind after the cleaning process.

A second type of print head cleaning system involves removing the ribbon and replacing the printer paper with a felt or cloth pad, which may have previously been impregnated with a cleanser or cleaning solvent. The printer is then operated in its normal fashion and dirt or ink adhering to the print head is transferred to the fabric pad. Such cleaning systems, while easier to use than the fibrous wad and solvent system outlined above, are, nevertheless, inconvenient since the printer paper must be replaced with the fabric pad and the printer ribbon must be removed.

Another type of print head or typewriter cleaning device is described in West German Pat. No. 31 46 242. This cleaning device is based on a removable cartridge insertable in a typewriter or printer in place of the inked ribbon cassette used for printing. Rather than an inked ribbon, this cleaning cassette contains a cleaning band which is fed across the soiled components of the typewriter or printer. The printer or typewriter is operated to transfer the ink adhering to the print head or typewriter components to the cleaning band; the soiled cleaning band is recycled into the cassette, where the cleaning band is pressed against a solvent-wet sponge to remove the transferred ink from the cleaning band. Such a cleaning cartridge may not completely clean the print head, particularly when a dry or particulate ink has been used, because of the inefficiency of transfer of the ink to the cleaning band.

It would thus be desirable to have a print head cleaning cartridge for dot matrix printers, daisy wheel printers, typewriters, and other impact-type printers, which is easy and convenient for the operator to use, that will not damage the printer, and is effective to remove substantially all traces of ink and dirt from the print head.

SUMMARY OF THE INVENTION

The present invention provides a simple, effective, and convenient cleaning method for removing ink, dirt, and the like from impact-type printing devices, such as dot matrix printers, daisy wheel printers, and typewriters. A cleaning cartridge for use WITH the present invention includes a cartridge body adapted to replace the inked ribbon cartridge of the device to be cleaned, a flexible and absorbent ribbon retained within the cartridge body such that, when the cleaning cartridge is inserted in the printer device, the cleaning ribbon is interposed between the print head and the platen. The cleaning cartridge also includes, in a region of the cartridge body adjacent a portion of the cleaning ribbon about to be advanced along the print head, a hole for dispensing a solvent onto the cleaning ribbon. When the printer is operated with the cleaning cassette, the ribbon drive of the printer advances the solvent-wetted portion of the cleaning ribbon between the print head and the printer platen so that the print head strikes the cleaning ribbon. Repeated contact between the solvent-wetted ribbon and the print head transfers ink, dirt, and the like from the print head to the ribbon. The portion of the cleaning ribbon following the solvent-wetted portion dries the print head during continued operation of the printer. When the cleaning cartridge is used with computer controlled or automatic printers, having a printer test program which repeatedly prints entire character sets, the print head is preferably cleaned while the printer is being run with the test program. However, any printer operation in which substantially all parts of the print head are contacted with the ribbon will be effective.

Typically, the cleaning ribbon comprises a continuous loop, six to twelve yards long, of a 4 mil thick woven nylon ribbon having a width approximately equal to that of the inked ribbon used for printing with the particular printer. Preferably, the continuous loop of cleaning ribbon includes a single 180° twist in the region underlying the hole provided for addition of the solvent. Such a twist renders the cleaning ribbon approximately horizontal beneath the solvent-dispensing hole so that the solvent may be efficiently applied to the ribbon. In addition, the use of a möbius twist allows the ribbon to be used for two complete cycles through the printer while presenting completely fresh cleaning ribbon to the print head throughout both cycles.

Preferably, the solvent, which may be dispensed from a dropper bottle or the like, is a water-soluble solvent, such as an alcohol, ketone, or ester, or a mixture of one or more of these with water. Most preferably, the solvent is a solution of 80–99% of isopropanol in water. Other solvents may be used, but should be compatible with the ribbon and cartridge materials and should dissolve the ink.

The cleaning method, according to the present invention, can be adapted to substantially any printer or typewriter which normally utilizes an inked ribbon mounted in a cartridge or cassette.

The method according to the present invention is easily, conveniently, effectively, and inexpensively applied to clean a print head without risk of damage to the printer components.

DETAILED DESCRIPTION OF THE PREFERRED EMBODIMENT

Figure 1:
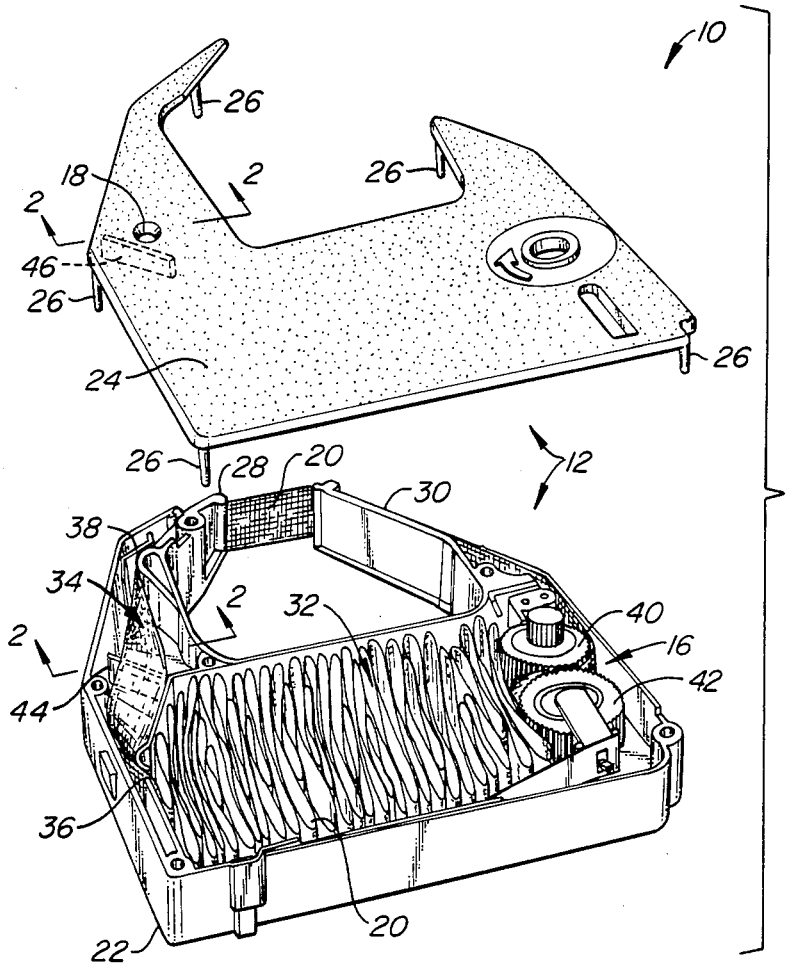
FIG. 1 is an exploded perspective view of the preferred embodiment of a cleaning cartridge for use with the invention.

FIG. 1 shows, in exploded perspective view, the preferred cleaning cartridge 10 for use with the present invention.

Cleaning cartridge 10 includes a cassette body 12 adapted to the printer whose print head is to be cleaned, a drive mechanism 16, a solvent opening 18, and a ribbon 20.

Cassette body 12 may be any one of a variety of cassettes or cartridges made for use with particular printers or typewriters; cassette body 12, as illustrated in FIG. 1, is adapted for use with a C.ITOH dot matrix printer. The preferred embodiment according to the invention will be described with respect to this cassette body 12; a suitable cassette body 12 is available, for example, from Echodata, Norcross, Ga. It is understood, however, that the invention is not limited to cleaning cartridges utilizing this particular cassette body 12.

Cassette body 12 includes a bottom 22 and a cover 24 adapted to fit together with posts 26. First and second ribbon guides 28 and 30 extend from cassette body 12 and are positionable on either side of the print head (not shown) for guiding ribbon 20 across the print head. When bottom 22 and cover 24 are fitted together, a ribbon receiving compartment 32 and a wetting area 34 are formed. In the particular cassette body 12 shown in FIG. 1, wetting area 34 is a separate compartment defined in cartridge body 12, separated from ribbon receiving compartment 32 and first ribbon guide 28 at slots 36 and 38, respectively. However, in alternate embodiments, wetting area 34 need not be so separated from the interior of cassette body 12.

Drive mechanism 16 includes a drive roller 40 and a take-up roller 42. Typically, impact printers include a ribbon drive motor (not shown), such as a stepping motor, for advancing an inked ribbon while printing. Drive roller 40 is preferably coupled to this ribbon drive motor (not shown) when cleaning cartridge 10 is inserted in the printer.

In cleaning cartridge 10 shown in FIG. 1, ribbon 20 is threaded between drive roller 40 and takeup roller 42, and is advanced through wetting area 34, and first and second ribbon guides 28 and 30 by the rotation of drive roller 40 against take-up roller 42. Ribbon 20 is then deposited in ribbon receiving compartment 32. Other suitable drive mechanisms 16 will be apparent to those skilled in the art and adapted to the particular cassette body 12 and printer of interest.

Preferably, ribbon 20 is a single continuous loop; in this case, the majority of the endless loop of ribbon 20 is folded to be stored in ribbon receiving compartment 32. In alternate embodiments of the invention, ribbon 20 can be mounted, for example, on dispensing and receiving spools (not shown) for dispensing ribbon to the wetting area 34 and receiving ribbon from drive mechanism 16. Although such an arrangement is comprehended by the present invention, it is not preferred since ribbon 20 could then be conveniently cycled only once through cleaning cartridge 10. A continuous loop, on the other hand, can easily be cycled repeatedly through cleaning cartridge 10.

In FIG. 1, only one edge of ribbon 20 is shown; ribbon 20 is thus oriented generally vertically when in place in the printer. In the preferred embodiment, wetting area 34 is provided with baffles 44 and 46 mounted to bottom 22 and cover 24, respectively, so as to define a generally horizontal slot 48, best shown in FIG. 2, between slot 36 and slot 38. When ribbon 20 is threaded through horizontal slot 48, ribbon 20 undergoes a half-twist in wetting area 34; the significance of this twist in the preferred embodiment will be discussed below. The twist may be in either of two directions; that is, the twist may be a 180° twist, such that ribbon 20 forms a möbius loop. Alternatively, ribbon 20 can be twisted approximately 90° between slot 36 and horizontal slot 48 and approximately 90° in the opposite direction between horizontal slot 48 and outlet slot 38, so that ribbon 20, when formed in an endless loop, will present the same side of ribbon 20 to the print head in successive cycles of ribbon 20 through cleaning cartridge 10. The use of the möbius-type twist of 180° presents one side of ribbon 20 to the print head in the first pass of the loop through cleaning cartridge 10 and the other side of ribbon 20 in the second complete pass of the ribbon 20. Further, in a printer configuration in which the print head impacts the inked ribbon off-center, different portions of ribbon 20 will be impacted by the print head during alternate cycles of ribbon 20 through cleaning cartridge 10, and ribbon 20 will be more efficiently utilized. Twisting of ribbon 20 in wetting area 34 also causes ribbon 20 to have an approximately horizontal configuration in the region of opening 18, thus facilitating the wetting of ribbon 20 with solvent.

Figure 2:
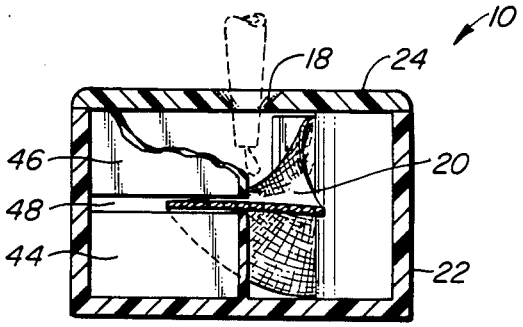
FIG. 2 is a cross-sectional view of a portion of the preferred embodiment for use with the invention along section 2—2 of FIG. 1, with portions cut away.

Solvent opening 18 is defined in cover 24 in the region of wetting chamber 34 such that a solvent may be applied to ribbon 20 immediately prior to the passage of ribbon 20 over the print head. Preferably, three to five drops (0.15–0.25 ml.) of a suitable solvent are applied to ribbon 20 through opening 18, as shown in FIG. 2. This quantity of solvent is typical; the proper quantity of solvent applied to ribbon 20 will vary, depending upon such factors as the material used for ribbon 20, the particular cassette body 12 being used, the color of ink previously used, and the size of the deposits on the print head that must be removed. Preferably, the solvent used is a polar, water-soluble solvent such as alcohol (e.g., methanol, ethanol, propanol, or isopropanol), a ketone (e.g., methylethylketone), acetone, ethyl acetate, or the like. A solution of greater than about 80% isopropanol in water has been found to yield particularly suitable results. Any solvent compatible with the ribbon material and the material from which the cassette body 12 is made and which, at the same time, satisfactorily dissolves ink residues, may be used.

Ribbon 20 is preferably about 6–12 yards long and about 4 mils thick. The width of ribbon 20 is chosen to approximately correspond to that of the inked ribbon used for printing with a particular printer. Preferably, ribbon 20 is woven nylon; other plastics may be used equally satisfactorily. Fabric ribbons, such as ribbons made of silk, cotton, linen, and so on, may also be used; however, such ribbons are generally not preferred due to their tendency to leave scraps of fiber behind on the print head.

Although the operation of cleaning cartridge 10 may be inferred from the above description, the preferred mode of operation of cleaning cartridge 10 in a printer will now be described.

After removing the inked-ribbon cartridge from the printer, cleaning cartridge 10 is inserted in the printer. The printer is then operated to impact the print head against ribbon 20 and advance ribbon 20. A few drops of solvent are added to ribbon 20 through opening 18. The solvent may be applied to ribbon 20 either prior to or during the operation of the printer. The wetted portion of ribbon 20 is advanced across the print head with the printer in operation; the ink, dirt, etc. on the print head is thus transferred to ribbon 20, which is then returned by drive mechanism 16 to ribbon receiving compartment 32. Operation of the printer is preferably continued to advance a dry portion of ribbon 20 across the print head to dry the print head. Preferably, the printer is operated to strike the wetted portion of ribbon 20 until all impact surfaces of the print head have been cleaned. Frequently, printers have a test program which causes the printer to repeatedly print, in sequence, each of the characters of the printers character set. In these cases, it is convenient to clean the print head while the printer is operating under the control of this program. Cleaning cartridge 10 may be used repeatedly; it has been found that ribbon 20 can be cycled through cleaning cartridge 10 several times without deterioration of cleaning effectiveness.

While the above is a complete description of the preferred embodiment of the invention, other arrangements and equivalents are possible and may be employed without departing from the true spirit and scope of the invention. For example, other variations in the structure and components of cleaning cartridge 10 will be readily apparent to those skilled in the art; similarly, it will be readily apparent to those skilled in the art that cleaning cartridges 10, for use with the invention, may be made with other cassette types and for types of impact printers not described above. Therefore, the description and illustration should not be construed as limiting the scope of the invention, which is delineated by the appended claims.

We claim:

1. In an impact printer having a print head and a platen, said impact printer being normally operated with a print cartridge mounted in said printer and containing a print ribbon arranged to pass between the print head and the platen, a method of cleaning the print head without removing the print head from the printer comprising the serial steps of:

providing a cleaning cartridge including a dry flexible absorbent cleaning ribbon;

mounting said cleaning cartridge in said impact printer in place of said print cartridge so that said cleaning ribbon passes between said print head and said platen;

manually applying a volatile solvent, in an amount selected and controlled by the user, directly to said cleaning ribbon at a single unexposed location within said cleaning cartridge to form a single, continuous, relatively short, wetted portion of said cleaning ribbon;

operating the printer to automatically advance the cleaning ribbon past said print head while causing the print head to impact against said wetted portion, thereby transferring ink and dirt residues from the print head to the wetted portion of the ribbon, said ribbon being impacted by said printer immediately after said solvent is applied; and operating the printer to automatically advance first the entirety of said wetted portion and second a dry portion of said cleaning ribbon past said print head while causing the print head to continuously impact said ribbon first to clean and subsequently to dry the print head.

* * * * *